United States Patent [19]

Wall

[11] Patent Number: 4,529,133

[45] Date of Patent: Jul. 16, 1985

[54] PROCESS FOR CRUSHING AND SIZING SOFT LIMEROCK

[75] Inventor: Rolfe E. Wall, Old Town, Fla.

[73] Assignee: Anderson Mining Corporation, Old Town, Fla.

[21] Appl. No.: 481,334

[22] Filed: Apr. 1, 1983

[51] Int. Cl.[3] ..... B02C 19/12

[52] U.S. Cl. ..... 241/20; 241/21; 241/24; 241/29

[58] Field of Search ..... 241/24, 16, 20, 21, 241/29, 60, 61, 78, 79, 80, 97

[56] References Cited

U.S. PATENT DOCUMENTS

| | | | |
|---|---|---|---|
| 2,378,356 | 6/1945 | Erck | 241/24 X |
| 2,635,104 | 4/1953 | Chayen | 241/24 X |
| 3,403,864 | 10/1968 | Cormican et al. | 241/24 X |

*Primary Examiner*—Mark Rosenbaum
*Attorney, Agent, or Firm*—Arthur G. Yeager

[57] ABSTRACT

A process which comprises passing soft limerock through a primary crusher, adding water to the crushed rock, passing the crushed rock and water through a series of screens with successively smaller screen openings while adding additional water to each screen, collecting the rock not passing through the screens and passing a portion of it through a secondary crusher and recycling the product to the series screens, collecting the rock passing through all screens and causing it to pass through a screw conveyor with a large excess of water and collecting fine particles of crushed soft limerock from the screw conveyor for use in preparing asphalt road paving material.

20 Claims, 1 Drawing Figure

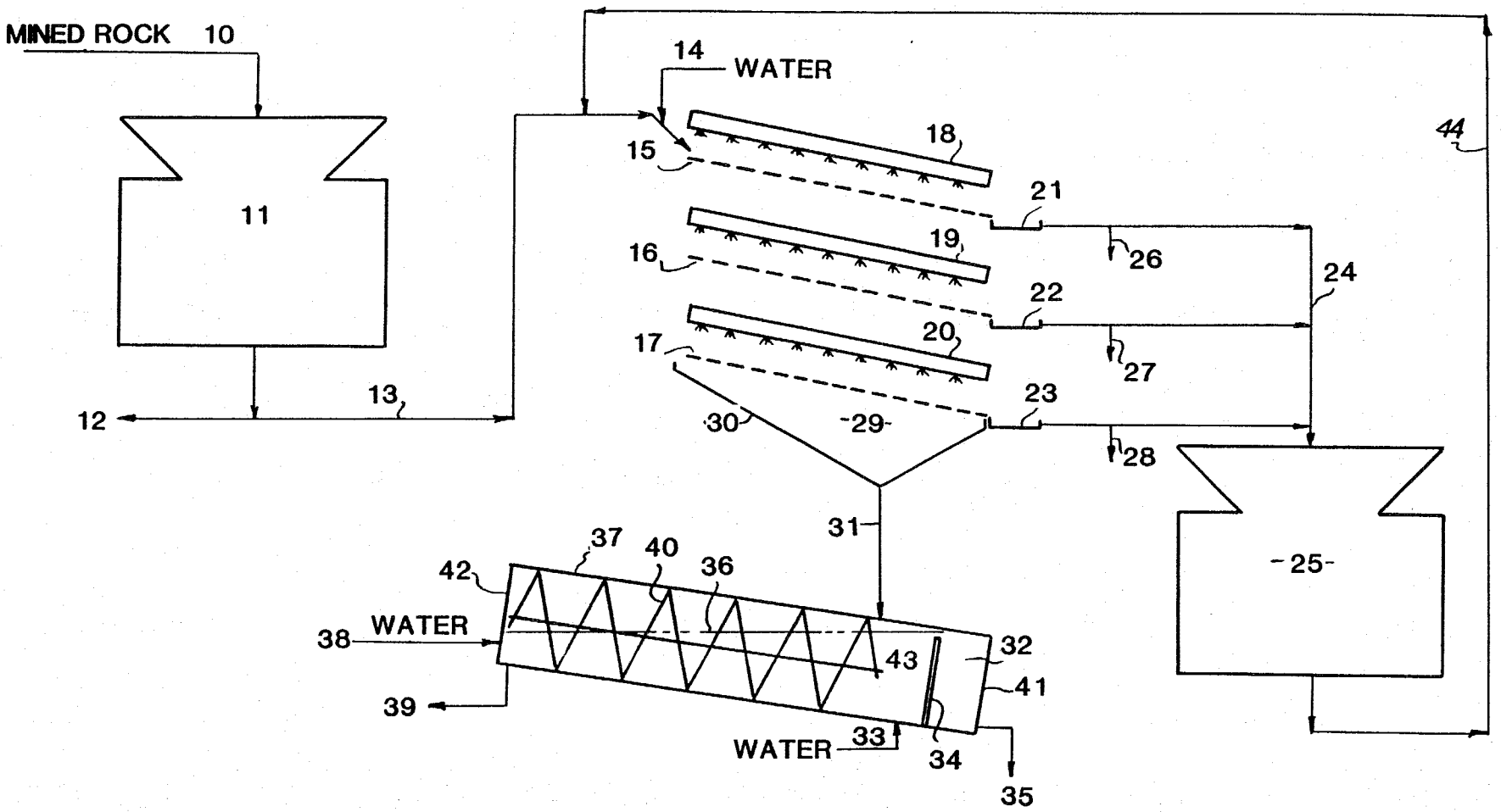
MINED ROCK
10
11
12
13
14
WATER
15
16
17
18
19
20
21
22
23
24
25
26
27
28
29
30
31
32
33
WATER
34
35
36
37
38
WATER
39
40
41
42
43
44

PROCESS FOR CRUSHING AND SIZING SOFT LIMEROCK

BACKGROUND OF THE INVENTION

This invention relates to a process for crushing soft limerock and separating the crushed rock into different particle size ranges in order to produce screenings used in asphalt mix for paving roads.

Limerock is a variety of limestone which is mined in sections of the southeastern portions of the United States, principally in Florida. Limerock is crushed and sized for use in various construction operations e.g. aggregate for concrete structures, roadbeds, drainage fields, screenings for use in asphalt paving compositions, etc. In general, limerock has been classified as hard or soft based upon an abrasion test well known to those skilled in this art wherein particles are subjected to a specific process of abrasion and the amount rubbed away is weighed to provide a number representing the percentage of weight loss due to abrasion. If that percentage is 45 or less the particles are known as "hard limerock" and if the amount lost by abrasion is greater than 45% the particles are known as "soft limerock". Hard limerock has been the preferred material for use in concrete; asphalt aggregates, drainage field aggregates, and has heretofore been the only source for screenings to be used in asphalt mixes for paving purposes.

Soft limerock has heretofore not been acceptable for use as screenings in paving operations, because soft limerock had been considered to be too soft and could not be economically sized to meet the specifications required by the federal, state and local government for screenings used in roadbuilding and for other paving uses. The present standards of the State of Florida for roadbuilding purposes is that screenings from crushed limerock must have the following sized specifications:

100% passing $\frac{3}{8}$ inch screen;

85–100 percent passing 4 mesh screen (0.187 inch opening); and

0–15% passing 200 mesh screen (0.0029 inch opening).

These specifications were not able to be met by prior art methods of sizing crushed soft limerock even though the crushed material would serve the purpose from the point of view of stability, wearability, etc. Furthermore the use of soft limerock would materially reduce the cost involved in roadbuilding since such material is derived from sources which are much less valuable than a similar size from hard limerock sources.

It is an object of this invention to provide a process for crushing and sizing soft limerock so as to produce screenings which will meet the requirements and specifications for use in asphalt paving operations. It is another object of this invention to provide a process for preparing several fractions of soft limerock having specific particle sizes. Still other objects will be apparent from the more detail description of this invention which follows:

BRIEF DESCRIPTION OF THIS INVENTION

This invention provides a process for preparing soft limerock particles in various particle size ranges comprising:

(a) subjecting natural soft limerock to a primary crushing operation;

(b) subjecting the primarily crushed rock to a size separation by passing the crushed rock through a series of screens of successive reductions in screen openings, and at the same time subjecting the primarily crushed rock on each of said screens to a sufficient amount of wash water to prevent plugging of said screens by said crushed rock:

(c) removing from each screen the rock particles not passing through that screen and recovering a portion of those rock particles;

(d) passing the remainder of said rock particles to a second crushing operation and recycling the secondarily crushed product to the primarily crushed rock being introduced to said series of screens; and (e) subjecting the crushed rock passing through the finest of said screens to a screw conveyor in the presence of a large excess of water and removing therefrom excessively fine particles of crushed limerock, clay, and other materials which are too soft or otherwise harmful in paving applications. In a specific embodiment of this invention there are employed at least three vibrating screens arranged such that the crushed rock being processed therethrough passes successively through each screen arranged in order such that each screen is of a smaller screen opening than the previous screen. In another specific embodiment of this invention the screw conveyor treats the particles passing through the finest of the screens in the sizing operation to remove extremely fine particles, clay, etc. and to remove fine particles of about 200 mesh or smaller in size; the screw conveyor operating partially submerged in the mixture of water and the crushed particles being processed thereby with the movement of particles being countercurrent to the movement of water. Still other embodiments will be apparent from the more detailed description of this invention which follows.

BRIEF DESCRIPTION OF THE DRAWINGS

The novel features believed to be characteristic of this invention are set forth with particularity in the appended claim. The invention itself, however, both as to its organization and method of operation, together with further objects and advantages thereof, may best be understood by reference to the following description taken in connection with the accompanying drawing showing a flow sheet of the process of this invention.

DETAILED DESCRIPTION OF THIS INVENTION

The invention may best be understood by reference to the accompanying drawing which is a flow sheet of the process of this invention. The mined rock which is to be processed is collected and introduced at 10 into a primary crusher 11 to reduce the size of the mined rock to that which may be separated into acceptable commercial size ranges. For purposes of general construction, road construction, etc. these ranges may be (1) greater than two inches, (2) 1–2 inches, (3) $\frac{3}{8}$–1 inch, (4) smaller than $\frac{3}{8}$ inch, and (5) fines which are smaller than 200 mesh. The product from the primary crusher 11 may be divided into two portions depending upon the interest of the operator. One portion 12 may be a mixture of all particle sizes delivered from the crusher which may be used as base rock in the construction of a roadbed, or the like. With respect to this invention the principal portion 13 of the product of primary crusher 11 is conducted to a screening operation which is depicted in the drawing as including screens 15,16 and 17, although this invention is not intended to be limited by any specific number of screens and is intended to include one or more screens, regardless of the number.

The screens are shown in a vertical arrangement, such that all of the material 13 is fed to the first screen 15. The material passing through the openings in screen 15 are dropped onto screen 16. The material passing through the openings in screen 16 are dropped onto screen 17. In such an operation as has just been described it is necessary that screen 15 have the largest screen openings of any of the screens in the operation, that screen 16 have smaller openings than those in screen 15, and that screen 17 have the smallest openings of all screens. In this fashion a continuous operation can be employed in which crushed rock portion 13 is fed to the uppermost screen 15 and size separations are achieved by collecting the material which does not pass each screen. As a preferred example, the openings in screen 15 are $1\frac{1}{2}$ inches, the openings in screen 16 are $\frac{3}{4}$ inch, and the openings in screen 17 are $\frac{3}{8}$ inch, it will be understood that there will be a size separation such that the particles collecting on the top of screen 15 will be $1\frac{1}{2}$ inches in dimension or greater, the particles collected on top of screen 16 will be $\frac{3}{4}$–$1\frac{1}{2}$ inches in size, and the particles particles collected on top 17 will be $\frac{3}{8}$–$\frac{3}{4}$ inch in size. The material passing through screen 17 is collected in hopper 30 and passed on to further processing which will be described below.

The particles collected on the top of screens 15,16 and 17 are collected respectively in receivers 21,22 and 23 for stockpiling elsewhere. It may well be that these separately collected portions of specifically sized particles will be separately stored and that further processing of such particles is not necessary. In other situations it may be preferable to treat the sized portions of particles to provide greater amounts of the smaller sized particles or other preferred product specifications. If the former alternative is preferred the products of the three screens 15,16, and 17 which have been collected in receivers 21,22, and 23 may be stored separately as products 26,27, and 28 respectively. In the case of the later alternative the products collected in receivers 21,22 and 23 are conducted to the inlet feed 24 of secondary crusher 25 and further processed. It is, of course, obvious that an operator may choose to process none, part, or all of anyone of the size portions collected in receivers 21,22, and 23. If further refinement of the collected particles is preferred and the particles are passed through secondary crusher 25 and the product of secondary crusher 25 is returned via line 44 to the feed line 13 which introduces crushed rock to the screening operation for recycling purposes. Thus the recycled crushed rock material from crusher 25 is added to the crushed rock portion 13 and the combination is fed to upper screen 15.

The manufacture of screenings from soft lime rock was seldom tried in the past because the material was considered to be too soft and when crushed would produce too many fines to be useful in an asphalt mix. Furthermore, it was believed that soft limerock in an asphalt mix would break under the weight of the paving rollers and product holes in the finished surface which would materially reduce the lift of the paving. In a few known instances when an attempt was made to produce acceptable screenings from soft limerock, the results were not acceptable because dry crushing operations resulted in screen clogging and did not produce the proper size particles in the screening in an amount that was commercially attractive.

One of the principal reasons for the success of this invention is that amounts of water are employed at different locations along with the rock material being processed to remove excess fines, to wash away the clay and other soft material, and to keep the screens unplugged. It is accomplished in three different steps. The total amount of water employed is substantially in excess of the amount of rock being treated. It is preferred that the amount of water be about 2 to 5, with the most desirable amount being about 3, times the volume of rock being treated. The manner of introduction of water to the crushed rock is not important so long as the water is distributed over all of the rock being treated and is in sufficient amount to avoid plugging of the screens.

The first step of introducing water to the crushed rock is at 14 where water is employed to thoroughly wet the rock just prior to its entry into the screening operation involving screens 15,16, and 17. If the rock is being treated continuously, as is the preferred case, the water introduced at 14 should also be fed continuously to rock portion 13.

The second introduction of water in the screening operation is accomplished by adding additional water to the particles as they are being processed by each of screens 15,16, and 17. In the drawing the method of introducing such water is shown as sprays 18, 19, and 20, respectively. The spraying of water over the top of the particles on each screen is the preferred method of introducing this water, but it is not necessarily the only method of so doing.

The material passing through screen 17 and collected in hopper 30 is a mixture of water and small particles 29 that is passed through a conduit or conveyor 31 to a washer-separator 37 wherein the third introduction of water takes place. The preferred type of washer-separator 37 wherein the third introduction of water takes place. The preferred type of washer-separator 37 is one involving a screw conveyor to move particles from inlet end 41 to outlet end 42. Mixture 29 is mostly water and when it is introduced into washer-separator 37 at inlet end 41 it causes screw conveyor 40 to be partially or totally submerged in the watery mixture 29. A preferred method of operation is to position screw conveyor 40 such that its axis is inclined upwardly from inlet end 41 to outlet end 42 thus making inlet end 41 almost completely submerged in watery mixture 29 while outlet end 42 is only slightly submerged as may be seen by water level 36.

The operation of washer-separator 37 is to pass the mixture of water and particles through this processing step such that the particles and the water move countercurrently with respect to each other. As may be seen in the drawing the solid particles in the mixture 29 being processed through washer-separator 37 will be moved toward outlet end 42 and withdrawn from washer-separator 37 through line 39 while water is removed at inlet end 41 through outlet line 35.

The composition of mixture 29 is frequently such that it contains a large amount of waste material that is undesirable, e.g. clay, and some extremely fine particles of limerock. These undesirable materials are preferably removed and discarded as waste material or may be processed for use as animal feed supplement for use in scrubbing sulfur dioxide from smoke from coal fired boilers, or for other commercial uses. The remaining small and fine particles of limerock are desirably collected as a product through line 39. The preferred method of operating washer-separator 37 is to employ a weir 34 in inlet end 41 of washer-separator 37. Weir 34 separates wash zone 43 from waste outlet zone 32. The feed from line 31 is introduced into wash zone 43 and, at the same time, additional water is introduced into wash zone 43 through line 33. Sufficient water 33 is introduced to cause turbulent flow in wash zone 43 causing the finer particles in mixture 29 to be carried to the upper part of that zone near water level 36 and to flow over weir 34 into zone 32. The heavier particles in mixture 29 will not be carried sufficiently high in wash zone 43 to pass over top of weir 34 and those heavier particles will be moved by screw conveyor 40 countercurrent to the flow of water toward outlet end 42 and withdrawn from washer-separator 37 through line 39 to become the product of this process having, for the most part, a particle size of less than ⅜ inch and down to about 200 mesh. The extremely fine particles, waste material, clay, etc. are removed at inlet end from waste outlet zone 32 through line 35 for disposal or for other uses mentioned above and not relevant to this invention. In order to obtain an appropriate washing of the particles being processed through washer-separator 37 the third important supply of water can be introduced at 38 at outlet end 42 to produce a countercurrent flow of water from outlet end 41 to inlet end 42 in the opposite direction to the flow of particles from inlet end 41 to outlet end 42 by a movement of screw conveyor 40.

The total amount of water introduced at these three locations is preferably divided into three proportions so as to provide the most efficient operation. Of the total water it is preferred that about 10–30%, desirably about 20%, by volume be introduced at 14; about 40–70%, desirably about 65%, at 18,19, and 20 onto screens 15,16, and 17, respectively; about 0–50%, desirably about 10%, at 33; and 0–20%, desirably about 5% at 38 into washer-separator 37.

There are several surprising and important advantages to the screenings made from the process of this invention as compared to screenings made from hard limerock. In the first place, it has been found that screenings of soft limerock made according to this invention exhibit a greater stability when the maximum particle size is ⅜ inch than when the maximum particle size is either smaller or larger than ⅜ inch, e.g. when the maximum particle size is ¼ inch or ½ inch). Stability tests are made on a prescribed asphalt mix employing the screening to be tested. The specifications of the test are set forth in ASTM Test Designation D 1559-76. Under such a test it was found that the Marshall stability at 140° F. was 750 for screenings of ¼ inch maximum size; 1027 for ⅜ inch maximum size; and 760 for ½ inch maximum size.

A second advantage is that comparable sizes of screenings from soft limerock have a lower density than hard limerock. Typical figures for specific gravity are 2.25 for soft limerock and 2.51 for hard limerock. This translates into a higher yield of finished asphalt paving per ton of screenings.

A third advantage of comparable sizes of screenings from soft limerock and hard limerock is that to produce the optimum asphalt paving there is less asphalt used with soft limerock than with hard limerock, e.g. 7.0% asphalt with soft limerock and 7.5% with hard limerock. This obviously means that a savings in the cost of materials can be realized by a paving contractor when using soft limerock as compared to using hard limerock.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A process for preparing sized portions of soft limerock particle which comprises:

(a) subjecting natural soft limerock to a primary crushing operation;

(b) subjecting the primarily crushed rock to size separation by passing the crushed rock through a series of screens having successively smaller screen openings, and at the same time subjecting the primarily crushed rock on each of said screens to a sufficient amount of wash water to prevent plugging of said screens by said crushed rock;

(c) removing from each screen the rock particles not passing through that screen and recovering a portion of those rock particles;

(d) passing the remainder of said rock particles to a second crushing operation and recycling the secondarily crushed product to the primarily crushed rock being introduced to said series of screens; and (e) collecting the crushed rock passing through the finest of said screens and feeding it into a screw conveyor which conveys the rock through a large excess of water, and recovering from the conveyor fine particles of crushed limerock.

2. The process of claim 1 wherein water is added to said primarily and secondarily crushed rock immediately prior to its introduction to the first screen in said series of screens.

3. The process of claim 1 wherein water is added to the crushed rock on each of said screens.

4. The process of claim 3 wherein the openings of said screens are in the range of 0.375 inch to 1.5 inch.

5. The process of claim 1 wherein said series of screens comprises at least three vibrating screens.

6. The process of claim 1 wherein said screw conveyor is positioned with the axis of said conveyor inclined upwardly from the end where the rock is fed into the conveyor to the end where the product rock is recovered and wherein said screw conveyor is partially submerged in the mixture of water and crushed rock particles being conveyed thereby.

7. The process of claim 6 wherein the rock is fed into a zone in the screw conveyor filled with water which flows upwardly and countercurrently to the introduction of feed material so as to produce a turbulent mixture of water and said material from said screens.

8. The process of claim 7 wherein water flows from said zone into a quiescent waste outlet section from which a mixture of fine particles, clay, and water is withdrawn from the screw conveyor.

9. The process of claim 6 wherein particles of limerock are moved upwardly through countercurrently flowing water and recovered from the upward end of the conveyor.

10. The process of claim 1 wherein water is introduced into said screw conveyor and is caused to flow countercurrently to the movement of crushed rock by said screw conveyor.

11. A process for preparing particles of soft limerock in selected size ranges, which comprises:

(a) crushing soft limerock in a primary crusher;

(b) introducing water to the crushed rock leaving the primary crusher;

(c) introducing the primarily crushed rock and the previously introduced water to a screening operation along with additional water to separate larger particles not passing through the screen from smaller particles passing through the screen;

(d) recovering a portion of said larger particles and subjecting the remainder of said larger particles to a secondary crusher (e) adding the secondarily crushed rock to said primarily crushed rock being introduced to said screening operation;

(f) subjecting said smaller particles mixed with water to a washing operation in a screw conveyor with said particles moving countercurrently with respect to said water; and recovering washed particles therefrom.

12. The process of claim 11 wherein the total volume of water added to the crushed rock during the entire process is about 2 to 5 times the volume of crushed rock being introduced to said screening operation.

13. The process of claim 12 wherein the amount of water being introduced onto the crushed rock as it is being processed through said screens is about 40%–70% of the total volume of water added to said rock in the entire process.

14. The process of claim 11 wherein said screening operation comprises a plurality of successive screens with said crushed rock being introduced onto each screen in an order of succession from the screen with the largest openings to the screen with the smallest openings.

15. The process of claim 14 which includes the continuous introduction of a substantial amount of water onto each of said screens.

16. The process of claim 14 which comprises at least three vibrating screens.

17. The process of claim 11 wherein said screw conveyor is positioned with the axis of said screw inclined upwardly from the feed end to the product end, and is partially submerged in water through which the crushed rock is conveyed.

18. The process of claim 17 wherein the inlet end of said conveyor includes a wash zone and a waste outlet zone, said wash zone comprising the lower end of said screw conveyor substantially completely submerged in turbulent water and receiving the crushed rock being fed thereinto for processing said waste outlet zone being a quiescent body of water and finely crushed rock which flows out of said conveyor.

19. The process of claim 11 wherein the amount of water added to the process at said screw conveyor is about 0%–70% of the total amount of water added to the entire process.

20. The process of claim 11 wherein the total amount of water used in the process is 2–5 times the volume of rock being processed, and wherein 10–30% of the water is introduced onto the rock between the primary crusher and the screening operation, 40–50% of the water is introduced at the screening operation, and the remainder is introduced into the screw conveyor.

* * * * *